United States Patent [19]

Hoover et al.

[11] Patent Number: 4,697,158

[45] Date of Patent: Sep. 29, 1987

[54] REDUCED HEIGHT WAVEGUIDE CIRCULATOR

[75] Inventors: John C. Hoover, Roswell; David E. Giese, Duluth, both of Ga.

[73] Assignee: Electromagnetic Sciences, Inc., Norcross, Ga.

[21] Appl. No.: 852,146

[22] Filed: Apr. 15, 1986

[51] Int. Cl.[4] ..... H01P 1/39

[52] U.S. Cl. ..... 333/1.1; 333/33

[58] Field of Search ..... 333/1.1, 33, 24.1, 24.2

[56] References Cited

U.S. PATENT DOCUMENTS 3,188,582 6/1965 Bowness ..... 333/24.2

3,341,789 9/1967 Goodman et al. ..... 333/1.1

3,534,276 10/1970 Berteaud et al. ..... 333/24.2 X 4,058,780 11/1977 Riblet ..... 333/1.1

*Primary Examiner*—Paul Gensler

*Attorney, Agent, or Firm*—Nixon & Vanderhye

[57] ABSTRACT

A conductive waveguide structure has a central cavity of full height and input/output ports of a second reduced height emanating therefrom. A smaller ferrite circulator element is centrally disposed within the cavity and has outer extremities spaced from the inner edges of the reduced height input/output ports by a predetermined gap dimension "G" which is chosen to achieve an appropriate impedance match between the impedance of the ferrite element and the higher impedance of the wavguide without the necessity for the usual quarter-wave dielectric impedance matching transformer sections.

21 Claims, 12 Drawing Figures

FIG. 1A
(PRIOR ART)
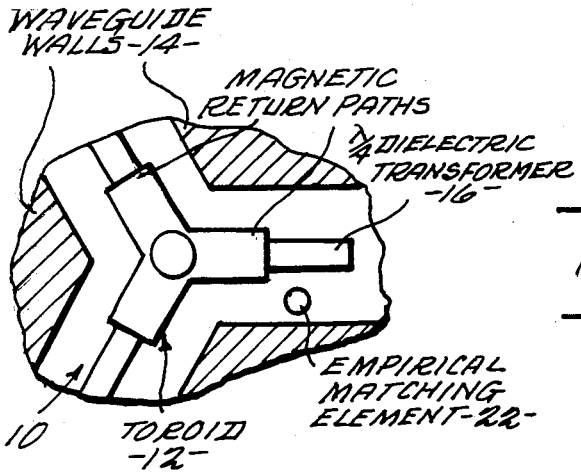
FIG 1B
(PRIOR ART)
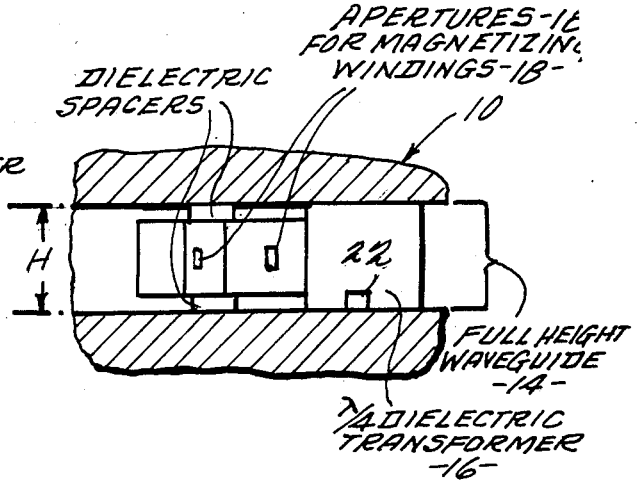
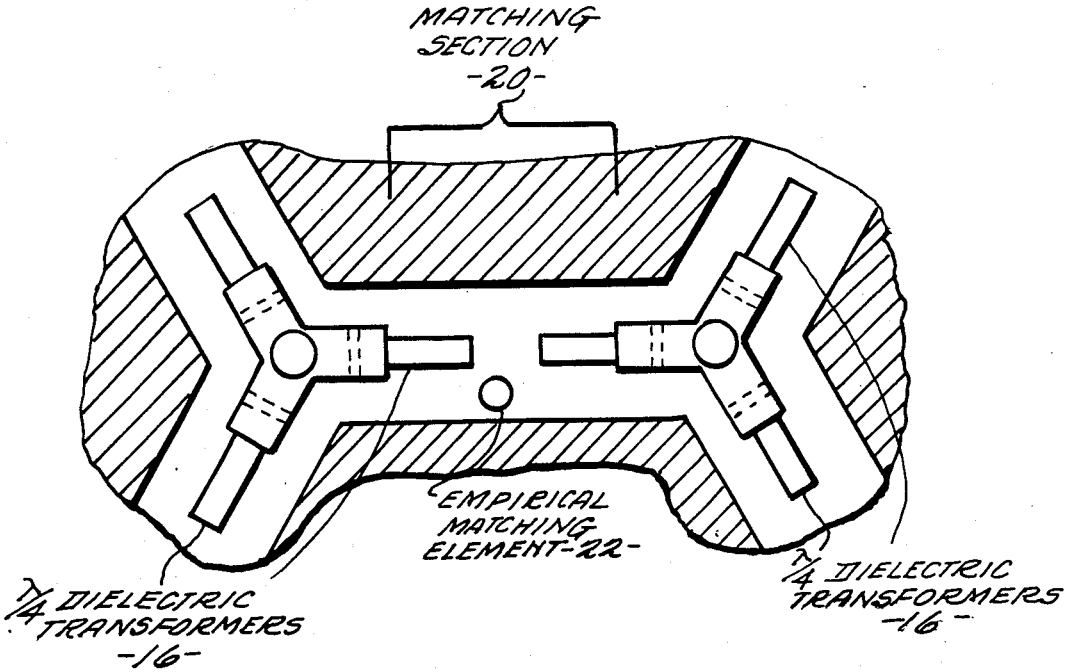
FIG. 2
(PRIOR ART)

REDUCED HEIGHT WAVEGUIDE CIRCULATOR

This invention is generally related to microwave waveguide circulator devices having ferrite circulator elements which are capable of coupling microwave energy to/from a pair of adjacent input/output ports while isolating a third input/output port.

The circulator phenomenon has been known and utilized for many years. However, the underlying theoretical basis for circulator operation is very complicated and not well understood in detail even today. There are many types of known circulator devices associated with different types of RF transmission line structures (e.g., waveguides, microstrip lines, strip lines, etc.). A few non-limiting examples of prior art publications citing such known circulator structures are set forth below:

1. "Broadband Latching Switches and Circulators, Fourth Quarterly Report", Research and Development Technical Report: ECOM-02445-4, March 1968, United States Army Electronic Command.
2. "The Compact Turnstile Circulator" by Brian Owen et al. IEEE Transactions on Microwave Theory and Techniques, Vol. MTT-18, No. 12, December 1970.
3. "The Identification of Modal Resonance in Ferrite Loaded Waveguide Y-Junctions and Their Adjustment for Circulation" by B. Owen, The Bell System Technical Journal, Vol. 51, No. 3, March 1972, pages 595–627.

Prior art constructions such as those described in these exemplary documents are depicted at FIGS. 1A, 1B and 2. Insofar as is relevant to the present invention, it should be noted that such devices typically include a rather massive quarter-wavelength dielectric transformer structure at the end of each ferrite element leg. Such dielectric transformers are typically used to match the lower impedance of the ferrite toroid structure to that of the waveguide. In addition, for various reasons such as tolerance variations and discontinuity capacitances, the return loss or isolation (match) is further improved by empirically locating a matching "trim" element such as a capacitive button or an inductive button in the area of the transformer waveguide interface (as is also depicted in FIGS. 1A–2).

Additional examples of prior art circulators, phase shifters, switches, etc. may be found in the following non-exhaustive list of prior issued U.S. Patents:

U.S. Pat. No. 3,231,835—Nielsen et al (1966)
U.S. Pat. No. 3,334,317—Andre (1967)
U.S. Pat. No. 3,355,679—Carr (1967)
U.S. Pat. No. 4,496,915—Mathew et al (1985)
U.S. Pat. No. 3,080,536—Dewhirst (1963)
U.S. Pat. No. 3,038,131—Uebele et al (1962)
U.S. Pat. No. 3,492,601—Omori (1970).

Nielsen et al use a raised magnetic pedestal in the area of the ferrite elements (which appears to be another form of quarter-wave transformer used in many permanent magnet H-plane circulators where the shape may vary from design to design, in some cases being circular or triangular or even a full width reduction in the height of the waveguide in the central area). Omori also uses quarter-wave transformers in an E-plane type of circulator device.

In short, the prior art in generally accepted the necessity for including relatively bulky impedance transformer devices at the interface between the ferrite circulator element extremities and the various input/output ports of a circulator device.

There are various disadvantages associated with the use of such transformers. For example, where dielectric transformers are involved, RF losses can be introduced in at least three different ways. First of all, the mere presence of the dielectric transformer material itself inherently introduces dielectric losses. Secondly, the dielectric causes a concentration of RF currents in the metal waveguide surfaces disposed directly above and below the dielectric transformer element thus increasing associated RF dissipation losses. Such dielectric transformers also are typically installed with the use of adhesives which introduce still further RF losses into the composite structure.

In addition, the effective useable bandwidth of a circulator device is ofter restricted by spurious resonance responses which may cause unacceptable increases in insertion losses and/or degradation of required isolation characteristics. Such spurious resonances are, at least in part, influenced by the presence and geometry of such transformer structures.

Furthermore, the transformer structures necessarily take up additional space which inherently increases the minimum separation distance that can be obtained in multi-junction assemblies when the input/output ports of multiple circulators are intercoupled so as to provide a more complex microwave switching arrangement. In some applications (e.g., in the feeding of phased array antenna assemblies with close inter-element spacing), it may be highly desirable to achieve a more compact multi-junction assembly of circulators than is possible when the usual prior art transformer structures are employed.

We have now discovered that it is possible to eliminate the dielectric or other matching transformer structures typically used in the prior art. Instead, the required impedance matching to the circulator junction is achieved by selecting a properly predetermined gap dimension "G" between the extremities of the ferrite element and a reduced-height input/output microwave port.

Since this arrangement inherently utilizes reduced-height waveguide for the input/output ports of the circulator, it is of particular benefit when employed within a microwave system where it is desired to use reduced-height waveguide.

While the gap dimension "G" is chosen to achieve the best intrinsic match between the ferrite and the reduced-height waveguide input/output ports, the match can be "trimmed" so as to be modified slightly in frequency and bandwidth by additional relatively small dielectric impedance-matching "trimming" elements placed directly on the legs of the Y-shaped ferrite toroid. Still further "trimmed" improvement in impedance matching may be obtained by the usual conventional empirically located additional matching capacitive/inductive "buttons" located in the vicinity of the waveguide transition area.

By thus eliminating the need for dielectric transformers, all of the inherent RF losses associated with the dielectric transformers may be avoided. In addition, it has been discovered that the elimination of the dielectric transformers and the related modification of the circulator geometry tends to raise the frequency of spurious resonances and therefore provide a greater usable frequency range or bandwidth. Finally, by avoiding the rather bulky transformer structures, a very compact multi-junction assembly of plural circulators can be achieved. For example, the minimum junctionto-junction spacing may be reduced to merely a short piece of reduced height waveguide so as to allow empirical matching and to prevent undesired interaction of the two junctions. Such a multi-junction assembly also provides a shorter electric length between the two junctions which, in itself, may sometimes be an important feature.

The advantages of this new arrangement can also be utilized even with full height waveguide systems by employing a single or multi-step quarter-wave transformer in the form of stepped waveguide height from the reduced height input/output port to the regular full height waveguide system. Although this sort of construction will inherently ncrease the physical and electrical length of a given structure, the increased usable bandwidth and possibly other advantages of the invention may still be obtained.

Although the exemplary embodiment is explained primarily with respect to a latching circulator switch junction, essentially the same construction and advantages apply to a fixed circulator junction which uses a latch current pulse of the same polarity (rather than of opposite polarity for switching the direction of circulation) or by use of permanent magnet biasing.

In brief summary, the new waveguide circulator utilizes a conductive waveguide structure having a central cavity and at least one input/output port of reduced height compared to the height of the central cavity. A ferrite circulator element of lesser dimensions than those of the cavity is then disposed centrally within the cavity so as to define a gap G between the inner edge of a reduced height input/output port and an extremity of the ferrite element, the gap G being dimensioned to achieve approximate impedance match between the element and waveguide structure.

The result is that one may achieve direct impedance matching into reduced height waveguide systems without the use of dielectric transformers. In addition, more compact multi-junction assemblies may be achieved due to the elimination of the space otherwise occupied by the dielectric transformers. And, greater operating bandwidth may be achieved due to the more effective impedance matching techniques and the elimination of and/or the moving to a higher frequency of higher order modes.

Furthermore, the new arrangement provides a somewhat simplified physical structure which may be constructed at lower costs and with greater repeatability due to the elimination of dielectric transformers. And the intrinsic isolation or return loss actually may be improved by properly sizing the gap G between the end of the toroid leg and the waveguide output. Still further improved impedance matching (and therefore improved isolation and return loss characteristics) may be obtained for both full and reduced height designs by locating dielectric "trimming" elements along the legs of the toroid. Finally, RF losses are reduced due to the elimination of the dielectric transformer structure and adhesives associated with it.

These as well as other objects and advantages of this invention will be more completely understood and appreciated by carefully reading the following detailed description of a presently preferred exemplary embodiment of this invention taken in conjunction with the accompanying drawings, of which:

FIGS. 1A and 1B are diagrammatic plan and side views respectively of a typical prior art waveguide circulator structure employing dielectric transformers;

FIG. 2 is a diagrammatic plan view of a multi-junction assembly of such prior art waveguide circulators employing dielectric transformers;

Figure 3:
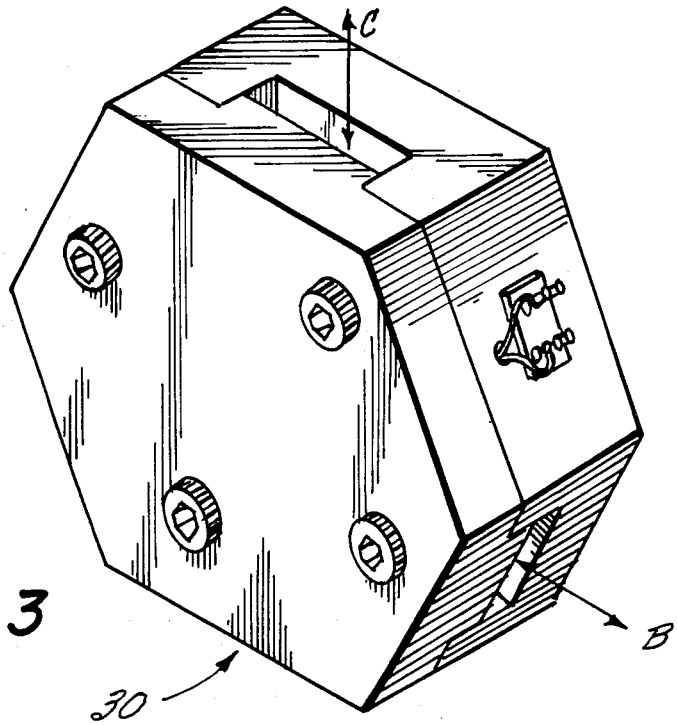
FIG. 3 is a perspective view of an exemplary embodiment of a reduced-height waveguide circulator switch constructed in accordance with this invention.
Figure 4:
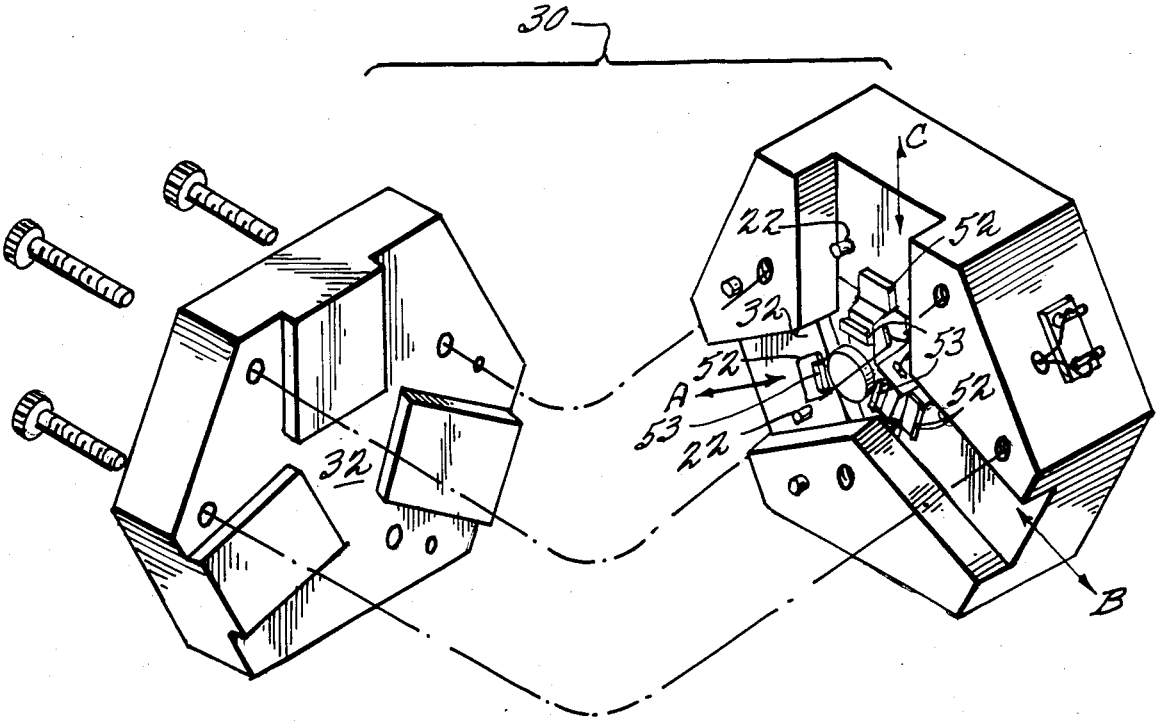
FIG. 4 is an exploded perspective view of the embodiment depicted in FIG. 3.
Figure 9:
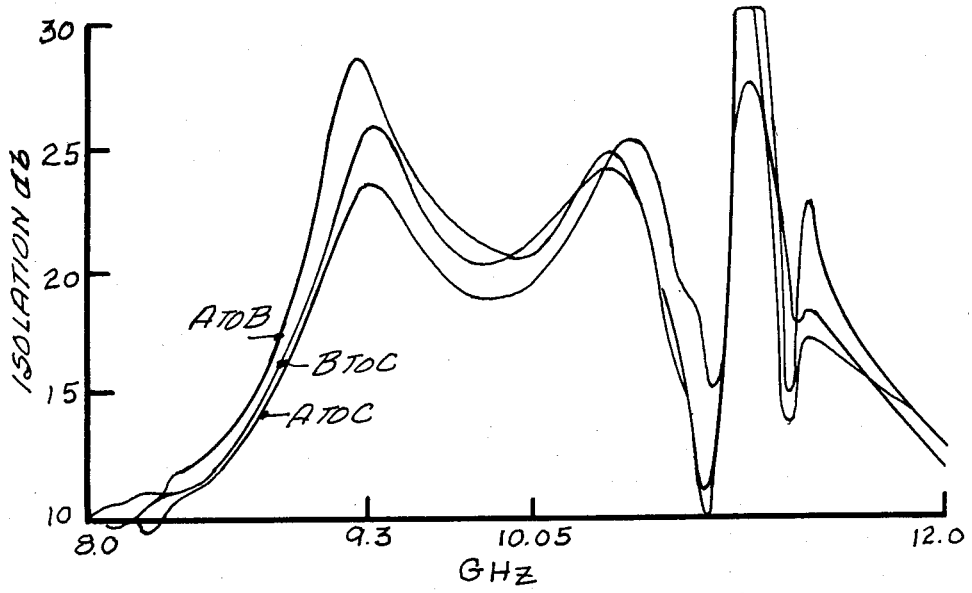
Figure 10:
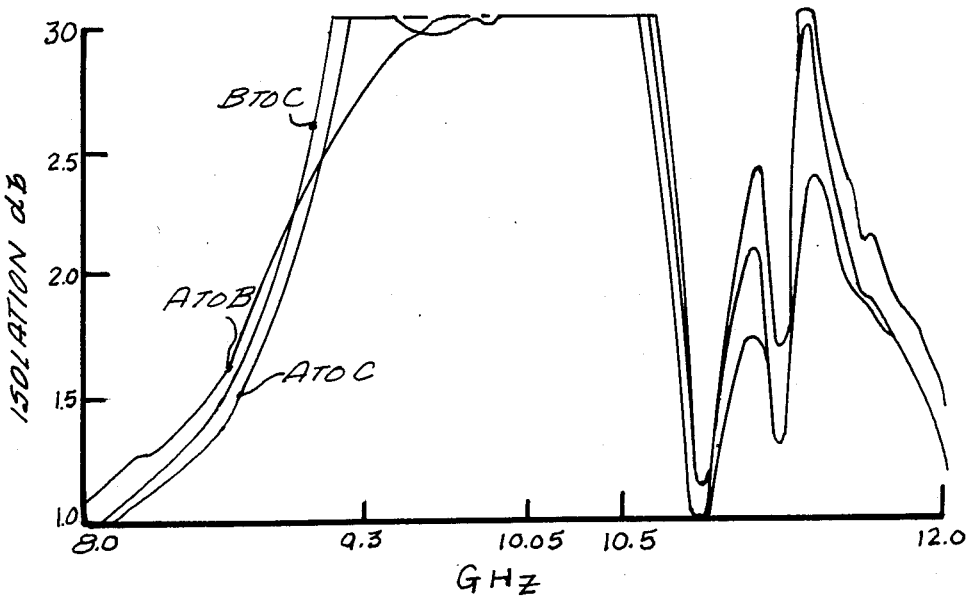

FIG. 9 is a graph showing the RF isolation obtained between various pairs of input/output ports for the exemplary embodiment of FIG. 3 employing only the intrinsic impedance matching obtained by properly dimensioned gap G; and FIG. 10 is a graph similar to that of FIG. 9 but showing the further improved isolation achieved by the addition of impedance-match trimming elements such as small dielectric chips mounted on each toroid leg and small conductive "buttons" disposed in the transition region in accordance with conventional empirical design practices.

As shown in FIGS. 1A and 1B, typical prior art waveguide circulators include a ferrite toroid structure of Y-shaped cross-section centrally disposed within a Y-shaped full-height waveguide junction 14. Dielectric transformers 16 (typically one or more quarter-wave length sections) of full-height are typically employed at the end of each extremity of toroid 12 so as to match the lower impedance of the ferrite toroid to the relatively higher impedance of the surrounding waveguide structure and, in particular, to the input/output ports of the full-height waveguide 14. If the circulator is to be of the switching/latching variety, then apertures 18 will be provided in each lef of the toroid 12 so that magnetizing windings of one or more turns of electrical wire may be passed through the aperatures 18 and through a wall of the waveguide to suitable electric drive circuits as is well known in the art.

As earlier noted, there are many disadvantages associated with the presence of dielectric transformers 16. One such disadvantage is that when multi-junction assemblies are created (as in FIG. 2), the minimum separation between two interconnected circulator devices (i.e., the minimum dimension of matching section 20) is limited by the need to include dielectric transformers 16.

As also depicted in FIGS. 1A, 1B and 2, it is conventional practice to "trim" or empirically improve the impedance match by including capacitive/inductive dimensioned metallic "buttons" (empirical matching elements 22) in the vicinity of the impedance transitioning section.

A reduced height waveguide circulator switch 30 in accordance with this invention is generally depicted at FIGS. 3–6. It includes three equi-angularly spaced input/output ports A, B, C of reduced-height waveguide (e.g., of a height dimension h3). At the center of such input/output ports, is a cavity 32 of increased height hl (e.g., "full-height" waveguide dimension). In the exemplary embodiment, this cavity has sides which form sections of an equilateral triangle and which are also defined by the inner edges of the reduced input/output ports A, B, C.

A Y-shaped (in cross-section) conventional ferrite circulator element 34 includes three equi-angularly spaced legs 36, 38 and 40 having respective apertures through which magnetizing windings such as wire 42 may be wound and passed through a suitable aperture in the waveguide to external connectors 44, 46. Conventional magnetizing currents may be passed through wire 42 and to switch the ferrite toroids defined by legs 36, 38 and 40 so as to cause "circulation" in either a clockwise or a counterclockwise sense. As will be appreciated by those in the art, when circulation is in one sense, then RF energy input to one port (e.g., port A) is efficiently coupled (e.g., with relatively low insertion loss) to the clockwise (or counterclockwise) adjacent port (e.g., port C) but is essentially RF isolated with respect to the remaining third port (e.g., port B). At the same time, RF inputs to ports C or B are respectively coupled to ports B or A while being isolated from ports A or C, respectively. If magnetizing current is passed in the opposite sense, then the "circulation" sense is likewise reversed.

In accordance with conventional design, the Y-shaped ferrite element 34 has a height h2, less than the full-height of the waveguide juncture and centrally disposed therewithin by dielectric spacers 48, 50 located at the top and bottom of the ferrite element 34. The dimensions of the ferrite element 34 and the full-height waveguide dimension h1 may be conventionally determined in accordance with usual practice so as to achieve latching circulator junction operations at the RF frequency of interest.

Figure 6:
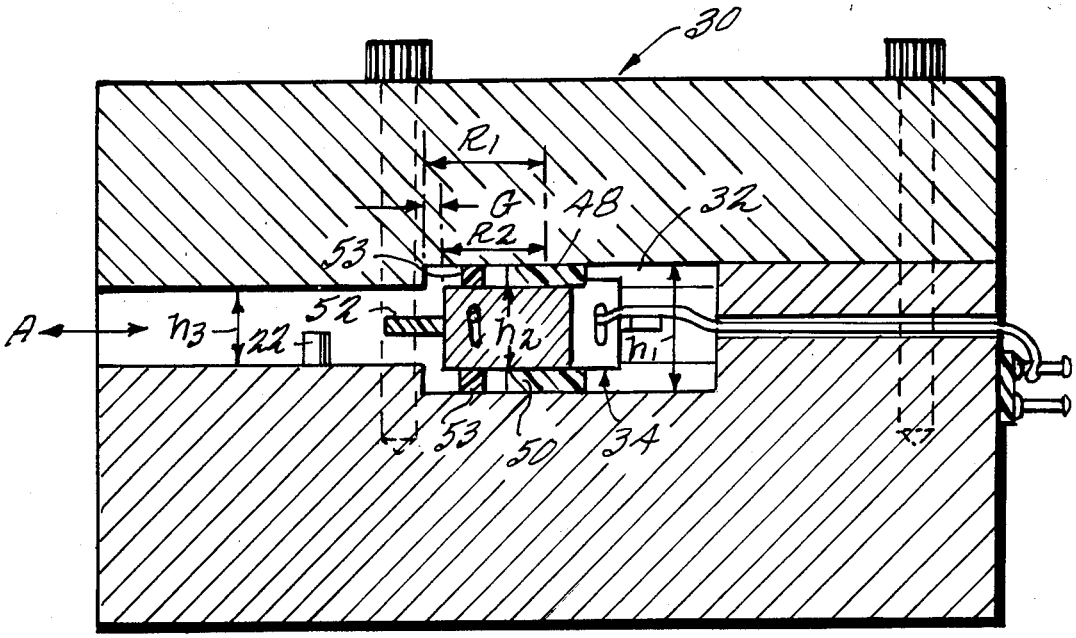
FIG. 6 is a cross-sectional depiction of the device shown in FIG. 3 taken along lines 6—6 of FIG. 5.

As will be appreciated from FIG. 6, the radial dimension R1 of the cavity 32 must be more than the radial dimension R2 of each leg of the ferrite element by a predetermined gap dimension G. It has been discovered that this gap G may be chosen so as to effect an impedance matching function between the legs of the ferrite element 34 and the desired transmission line (e.g., the reduced height waveguide input/output ports A, B, C).

Although the exact functioning of any RF circulator device is extremely complicated and probably not accurately understood even yet in all details, it is thought that the legs of the Y-shaped toroid may themselves tend to (at least in part) provide quarter-wave transformer functions typically associated with the waveguide circulator junctions. The circulator function itself is, of course, determined by the ferrite structure 34 with its dielectric spacers 48, 50 in accordance with conventional design and theory. However, when the configuration of FIGS. 3–6 is provided, the gap G somehow acts to effect an intrinsic approximate impedance match to the reduced-height input/output ports.

The gap G may not need to be used on all three legs of the toroid 34. For example, one or more legs of the toroid may have conventional full-height waveguides with the conventional dielectric quarter-wave transformer as their input/output ports. This modified form of construction might be used, for example, where the reduced-height waveguide input/output port is only required at one port of the circulator device.

Although in the exemplary embodiment, gap G was empirically determined (using practices similar to those employed for determining the proper dimensions/locations of empirical impedance match trimming buttons 22), it also may be possible to derive a complex theoretical calculation. In any event, once determined for one frequency, the dimensions can be simply frequency scaled to other frequency bands (as may the other dimensions of the circulator).

It has also been discovered that relatively small impedance match "trimming" dielectric elements 52 may be directly associated with each leg of the ferrite toroid 34 so as to even further enhance the impedance match. These relatively small dielectric trim elements 52 may be used, as are the conventional matching buttons 22, to empirically modify the frequency response of the device and may be equally well used on conventional full-height design circulators.

Figure 5:
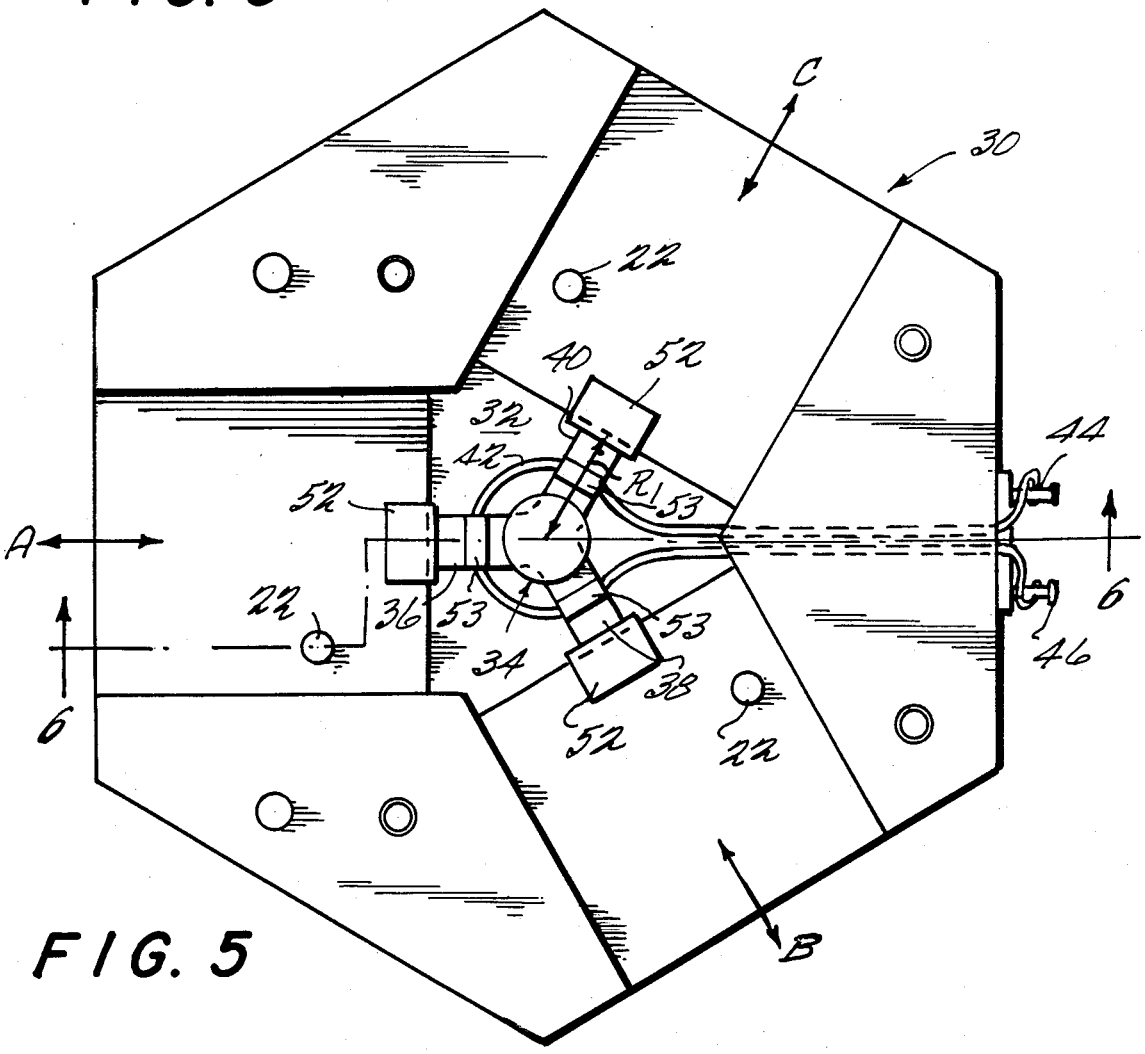
FIG. 5 is a plan view of a portion of the assembly depicted in FIG. 3 but with the top thereof removed.

Although the "on leg matching" feature is considered optional, some noticeable improvement in isolation may be achieved by use of these additional elements. As one example of such elements, in the X-band exemplary embodiment, the element 53 (of which 6 were used per toroid) were about 0.156 inch wide and 0.062 inch in height (the same height or thickness as dielectric spacers 48, 50) and ran the full width of the toroid leg symmetrically placed on the top and bottom of the legs of the toroid as best depicted in FIG. 5. One suitable material for element 53 is Emerson's and Cumming's low K with a dielectric constant of about 1.7. Similarly ceramic elements may be placed on the ends of the legs as shown as Item 52 of FIG. 4. A typical size for element 52 is 0.25 inch wide by 0.25 inch long and 0.050 inch thick. One suitable material is Trans Tech's DS6. The exact size, material and placement of 52 and 53 is determined empirically.

Other typical dimensions for an exemplary embodiment of FIGS. 3–6 (designed for the frequency band of 9.3 to 10.05 GHz) are as follows:

h1=0.414 inch
h2=0.290 inch
h3=0.200 inch
G=0.040 inch
R2=0.336 inch
$R1=R2+G=0.376$ inch The swept frequency response for the exemplary embodiment using its intrinsic approximate impedance matching obtained only by gap G (without auxiliary impedance match trimming devices) is depicted in FIG. 9. Here, three curves show the isolation achieved respectively between ports A-B, B-C, and A-C, over a range of frequencies in the X-band. Although one of the curves is slightly below 20 db isolation, FIG. 9 demonstrates that a commercially acceptable 20 db minimum is possible over a frequency band of 9.3 to 10.05 GHz.

FIG. 10 is a similar swept frequency response but now using empirical impedance match "trimming" elements 52 and 22 in the waveguide input/output ports. As can be seen in FIG. 10, the isolation between ports is now considerably better than 25 db for all three port combinations over the entire 9.3 to 10.05 GHz band.

Figure 8:
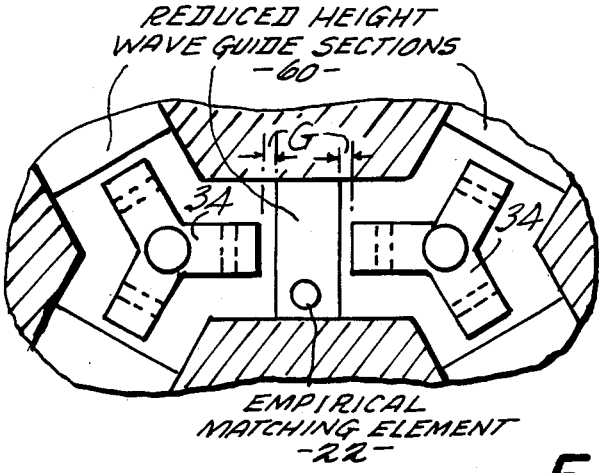
FIG. 8 is a diagrammatic plan view of a multi-junction assembly of circulator structures in accordance with this invention showing the more compact possible arrangement thereof.

As earlier noted with respect to the prior art multi-junction assembly in FIG. 2, it is sometimes desirable to couple plural circulator devices together for more complex switching arrangements. As depicted in FIG. 8, (and as may be compared to FIG. 2), a much more compact multi-junction assembly may be achieved using the reduced height input/output port circulator switches of this invention. For example, as depicted in FIG. 8, only a short section of reduced-height waveguide 60 is needed between the multi-junction joints of plural circulator devices 34. That is, the impedance matching gap G may be defined by a relatively short waveguide section 60 thus making a much more compact multi-joint structure. In addition, to desired physical compactness, the shorter electrical length may also be important in many applications.

Figure 7A:
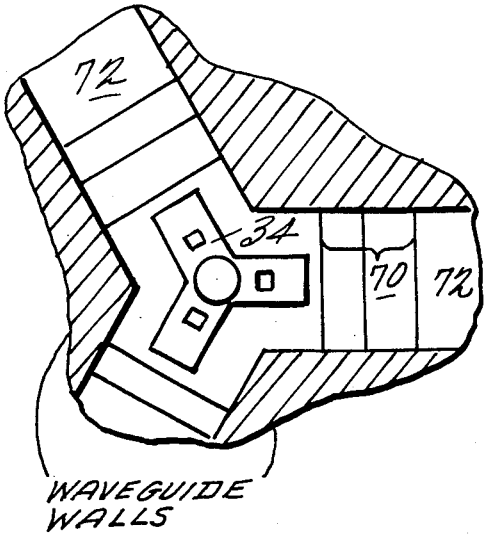
FIGS. 7A and 7B are a diagrammatic plan and side view of an exemplary embodiment of this invention adapted for use with full-height waveguide systems.
Figure 7B:
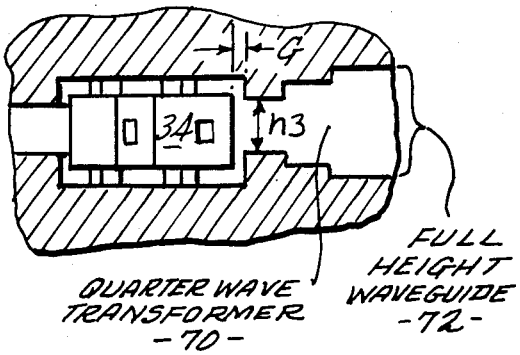

If a full-height waveguide system is at hand, many advantages associated with this new construction can still be obtained by employing a single or multi-step quarter-wave transformer (of conventional design) between the reduced-height input/output port of the improved circulator and the full height waveguide 72 as depicted in FIGS. 7A and 7B.

While only a few exemplary embodiments of this invention have been described in detail, those skilled in the art will appreciate that many variations and modifications may be made in these exemplary embodiments while yet retaining many of the novel features and advantages of this invention. Accordingly, all such modifications and variations are to be included within the scope of the appended claims.

What is claimed is:

1. A waveguide circulator comprising:

a conductive waveguide structure having a cavity located therewithin of a first predetermined height and said cavity having plural input/output waveguides of a second lesser predetermined height emanating therefrom:

a ferrite circulator element disposed within said central cavity and having an outer extremity spaced from an inner edge of at least one of said input/output waveguides by a gap G having a predetermined gap dimension which achieves an approximate impedance match between the impedance of the ferrite element and the higher impedance of a reduced height input/output waveguide and means for creating a magnetic field within said ferrite element and causing it to act as a circulator element.

2. A waveguide circulator as in claim 1 further comprising:

at least one dielectric impedance-match trimming element disposed adjacent said ferrite circulator element and being dimensioned and located to further improve the impedance match between the ferrite element and a reduced height input/output waveguide.

3. A waveguide circulator as in claim 2 further comprising:

at least one conductive impedance-match trimming element disposed within at least one of said reduced height input/output waveguides and being dimensioned and located to further improve the impedance match between the ferrite element and the waveguide.

4. A waveguide circulator as in claim 1 wherein said ferrite element is of an intermediate height less than said first predetermined height and greater than said second predetermined height and comprising a dielectric spacer element located above and below said ferrite element so as to secure it within said cavity.

5. A waveguide circulator as in claim 1 wherein said ferrite element has a Y-shaped cross-section.

6. A waveguide circulator as in claim 5 wherein each leg of the Y-shaped element includes an aperture and an electrical latching circuit passes therethrough and through said waveguide structure so as to provide an electrically switched latching waveguide circulator.

7. A waveguide circulator as in claim 1 wherein at least one reduced height input/output waveguide from the waveguide structure is coupled to at least one reduced height input/output port of a second similar waveguide structure to form a multi-junction waveguides circulator structure of increased compactness.

8. A waveguide circulator as in claim 1 wherein at least one of said reduced height input/output, waveguides includes quarter-wave transformer stepped sections of increasing height emanating outwardly from said cavity and providing transition to a full height input/output waveguide section having a height at least equal to said first predetermined light.

9. A waveguide circulator comprising:

a conductive waveguide structure having a central cavity located therewithin and said cavity having plural input/output waveguide ports emanating therefrom, at least one of said input/output waveguide ports being of reduced height compared to the height of said central cavity; and a ferrite circulator element of lesser dimensions than those of said cavity; and means for creating a magnetic field within said ferrite element and causing it to act as a circulator element;

said element being disposed within said cavity and defining a gap G between a waveguide port of reduced height and an extremity of said element, said gap G being dimensioned to achieve an approximate impedance match between said element and said reduced height input/output waveguide port.

10. A waveguide circulator as in claim 9 further comprising:

a least one dielectric impedance-match trimming element disposed adjacent said ferrite circulator element and being dimensioned and located to further improve the impedance match between the ferrite element and a reduced height input/output port.

11. A waveguide circulator as in claim 9 wherein said ferrite element is of an intermediate height less than said first predetermined height and greater than said second predetermined height and comprising a dielectric spacer element located above and below said ferrite element so as to secure it within said cavity.

12. A waveguide circulator as in claim 9 wherein said ferrite element has a Y-shaped cross-section and wherein each leg of the Y-shaped element includes an aperture and an electrical latching circuit passes therethrough and through said waveguide structure so as to provide an electrically switched latching waveguide circulator.

13. A waveguide circulator as in claim 9 wherein at least one reduced input/output port from the waveguide structure is coupled to at least one reduced height input/output port of a second similar waveguide structure to form a multi-junction waveguide circulator structure of increased compactness.

14. A waveguide circulator as in claim 9 wherein at least one of said reduced height input/output ports includes quarter-wave transformer stepped sections of increasing height emanating outwardly from said cavity and providing transition to a full height input/output waveguide section having a height at least equal to said first predetermined height.

15. A reduced height waveguide circulator comprising:

a Y-shaped ferrite circulator element having three legs spaced apart at 120° angular intervals, having a height dimension h2 and a radial dimension R2;

means for creating a magnetic field within said ferrite element and causing it to act as a circulator;

a conductive waveguide structure having a cavity of height h1, where h1>h2, and of equilateral triangular cross-section and of radial dimension $R=R2+G$ measured from the cavity center along a normal to a side of the cavity; and an input/output port waveguide of height h3, where h3<h2<h1, coupled to each side of the cavity, said circulator element being centrally located within the cavity with dielectric spacers above and below the element in the height dimension and said element also having each of its legs centrally aligned with a respective one of said input/output ports;

said circulator element and the inner edge of said input/output ports thereby defining a gap of dimension G which causes the impedance of said circulator element to be approximately matched to the higher impedance of said waveguide structure.

16. A reduced height waveguide structure as in claim 15 further comprising:

at least one dielectric impedance-match trimming element disposed adjacent said ferrite circulator element and being dimensioned and located to further improve the impedance match between the ferrite element and the waveguide.

17. A reduced height waveguide structure as in claim 15 further comprising:

at least one conductive impedance-match trimming element disposed within at least one of said input-/output ports and being dimensioned and located to further improve the impedance match between the ferrite element and the waveguide.

18. A reduced height waveguide structure as in claim 16 further comprising:

at least one conductive impedance-match trimming element disposed within at least one of said input-/output ports and being dimensioned and located to further improve the impedance match between the ferrite element and the waveguide.

19. A reduced height waveguide structure as in claim 15 wherein each leg of the Y-shaped element includes an aperture and an electrical latching circuit passes therethrough and through said waveguide structure so as to provide an electrically switched latching waveguide circulator.

20. A reduced height waveguide structure as in claim 15 wherein at least one input/output port from a first one of the waveguide structures is coupled to at least one input/output port of a second similar waveguide structure to form a multi-junction waveguide circulator structure of increased compactness.

21. A reduced height waveguide structure as in claim 15 wherein at least one of said input/output ports includes quarter-wave transformer stepped sections of increasing height emanating outwardly from said cavity and providing transition to a full height input/output waveguide section having a height at least equal to said first predetermined height.

* * * * *